US009334651B2

(12) United States Patent
Grubka et al.

(10) Patent No.: US 9,334,651 B2
(45) Date of Patent: May 10, 2016

(54) SYSTEM AND METHOD FOR ATTACHING SHINGLES TO A ROOF

(71) Applicant: Owens Corning Intellectual Capital, LLC, Toledo, OH (US)

(72) Inventors: Lawrence J. Grubka, Westerville, OH (US); Christopher C. Freidner, Granville, OH (US); Venkata S. Nagarajan, New Albany, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 14/736,555

(22) Filed: Jun. 11, 2015

(65) Prior Publication Data

US 2015/0361666 A1 Dec. 17, 2015

Related U.S. Application Data

(60) Provisional application No. 62/013,086, filed on Jun. 17, 2014.

(51) Int. Cl.
*E04D 1/34* (2006.01)
*E04D 1/26* (2006.01)

(52) U.S. Cl.
CPC .. *E04D 1/34* (2013.01); *E04D 1/26* (2013.01); *E04D 2001/3423* (2013.01); *E04D 2001/3435* (2013.01); *E04D 2001/3491* (2013.01)

(58) Field of Classification Search
CPC ..... E04D 1/34; E04D 1/26; E04D 2001/3423; E04D 2001/3491; E04D 2001/3435
See application file for complete search history.

(56) References Cited

U.S. PATENT DOCUMENTS 3,915,299 A 10/1975 Miyaoku
4,763,456 A * 8/1988 Giannuzzi ..... E04D 3/3603 411/133
4,826,381 A 5/1989 Kiriyama
4,987,714 A * 1/1991 Lemke ..... E04D 3/3603 411/369

(Continued)

FOREIGN PATENT DOCUMENTS

EP 392568 10/1990
GB 2338765 12/1999

(Continued)

OTHER PUBLICATIONS

Utility Composites Intl Ltd., Nail/Staple Technical Data brochure, 3 pages, 2011.

*Primary Examiner* — Rodney Mintz
(74) *Attorney, Agent, or Firm* — Calfee, Halter & Griswold LLP

(57) ABSTRACT

Roof systems and related method having a roof deck, a plurality of shingles, and a plurality of fasteners, having a material that partially changes state and displaces into the roof deck material to secure the fasteners and shingles to the roof deck. The shingles can be positioned in an overlapping pattern, and the fasteners can have first portions configured to penetrate into the roof deck and can have at least one material that melts at a threshold temperature. The first portions of the fasteners extend through one or more shingles and penetrate into the roof deck, where the material of the first portion of the fasteners increases in temperature above the threshold temperature, partially changing into a more flowable state, and displaces into voids in the material of the roof deck. Second portions of the fasteners engage the upper surfaces of the shingles to secure the shingles to the roof deck.

25 Claims, 8 Drawing Sheets

(56) References Cited

U.S. PATENT DOCUMENTS

| | | | | |
|---|---|---|---|---|
| 5,193,958 | A * | 3/1993 | Day | B05D 3/0426 411/387.1 |
| 5,260,100 | A * | 11/1993 | Day | B05D 3/0426 427/386 |
| 5,785,478 | A * | 7/1998 | Rotter | E04D 1/34 411/424 |
| 5,795,121 | A | 8/1998 | Tucker et al. | |
| 6,035,595 | A * | 3/2000 | Anderson | E04F 13/045 411/258 |
| 6,168,362 | B1 | 1/2001 | Tucker et al. | |
| 6,899,502 | B2 * | 5/2005 | Strunk | F16B 15/00 411/442 |
| 7,160,405 | B2 | 1/2007 | Aeschlimann et al. | |
| 7,600,957 | B2 * | 10/2009 | Phillips | C08G 59/5026 411/82.2 |
| 7,950,885 | B2 * | 5/2011 | Rosenkranz | F16B 25/0026 411/258 |
| 8,920,088 | B1 * | 12/2014 | Garvin | F16B 15/0092 411/442 |
| 2005/0126680 | A1 | 6/2005 | Aeschlimann et al. | |

FOREIGN PATENT DOCUMENTS

| | | |
|---|---|---|
| JP | S52-104575 | 9/1977 |
| JP | 2004-076839 | 3/2004 |
| WO | 95/22697 | 8/1995 |

* cited by examiner

SYSTEM AND METHOD FOR ATTACHING SHINGLES TO A ROOF

RELATED APPLICATIONS

The present application claims the benefit of U.S. provisional patent application Ser. No. 62/013,086, titled "System for Attaching Shingles to a Roof," filed on Jun. 17, 2014. U.S. provisional patent application Ser. No. 62/013,086 is incorporated herein by reference in its entirety.

TECHNICAL FIELD

The present disclosure is directed to roofing systems, in particular systems and methods for attaching shingles to a roof deck utilizing fasteners having a material that displaces into voids in the roof deck, thereby attaching the fasteners to the roof deck.

BACKGROUND

Roofing systems protect residential and commercial buildings from damage caused by exposure to moisture, temperature, radiation, wind, and other atmosphere related elements. The building industry utilizes many different types of roofing systems, including thatch, ceramic tile, shingle, membrane, metal, and concrete, among others. In particular, shingle roofing systems are utilized extensively in the residential and commercial construction industries, and these shingle roofing systems can employ shingles made from a variety of different materials. In addition to protecting the underlying structure, shingle roofing systems contribute to the aesthetic appearance of residential and commercial buildings. To that end, shingles used in these roofing systems are available in a variety of shapes, sizes, colors, textures, and other aesthetic properties.

SUMMARY

The present disclosure is directed to roofing systems having a roof deck, a plurality of shingles, and a plurality of fasteners, having a material that partially changes state and displaces into the roof deck material to secure the fasteners and shingles to the roof deck. The roof deck has an outer surface. Each of the shingles has an upper surface, a covered headlap portion, and an exposed prime portion and can be positioned in an overlapping manner such that the exposed prime portions of the shingles at least partially cover the covered headlap portions of one or more shingles previously attached to the roof deck. The fasteners can have first portions configured to penetrate into the roof deck and can have at least one material that melts at a threshold temperature. The first portions of the fasteners extend through one or more shingles and penetrate into the roof deck, where the material of the first portion of the fasteners increases in temperature above the threshold temperature, partially changes into a more flowable state, and displaces into voids in the material of the roof deck. Second portions of the fasteners engage the upper surfaces of the shingles to secure the shingles to the roof deck.

The present disclosure includes a method for attaching a shingle to a roof deck. The method includes positioning the shingle on the roof deck and positioning a first portion of a fastener above an upper surface of the shingle. The first portion of the fastener can be configured to penetrate into the roof deck and can have at least one material that can melt at a threshold temperature. The method includes the step of applying a force to the fastener so that the first portion penetrates the roof deck. Upon penetration of the first portion into the roof deck, a temperature of the first portion rises above the threshold temperature, which melts a portion of the material of the first portion. The melted material of the first portion then displaces into voids in the material of the roof deck. The method includes engaging the upper surface of a shingle with a second portion of the fastener to attach the shingle to the roof deck.

DESCRIPTION OF THE DRAWINGS

The foregoing and other exemplary embodiments of the present disclosure will become more fully apparent from the following drawings, which are incorporated in and constitute a part of the specification. Understanding that these drawings depict only several embodiments in accordance with the disclosure and, therefore, are not to be considered limiting of its scope, the disclosure will be described with additional specificity and detail through the use of the accompanying drawings.

DESCRIPTION

Figure 1A:
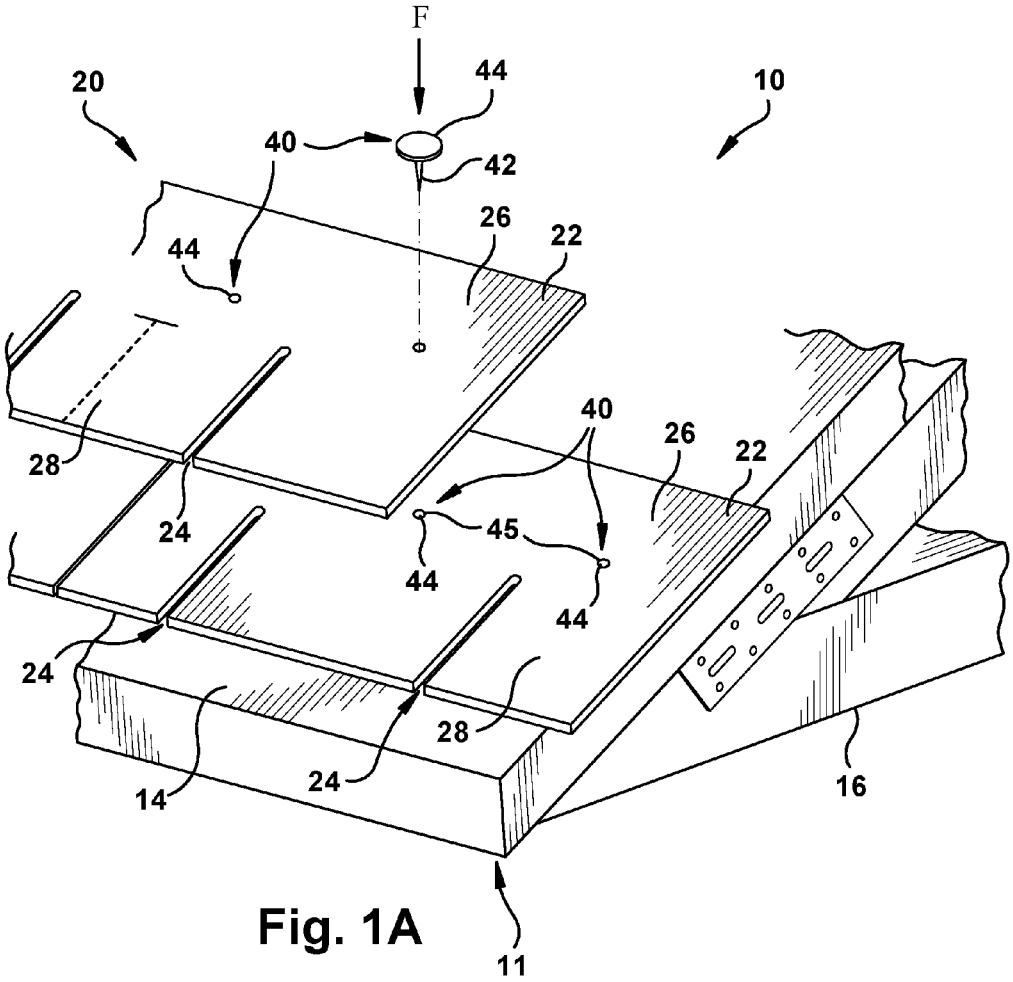
FIG. 1A is a perspective view of an exemplary embodiment of a roofing system having fasteners positioned in the covered headlap portion of the shingle.

The present disclosure will now be described in further detail with reference to various exemplary embodiments. Except as otherwise specifically defined herein, all terms used herein have the same meaning as commonly understood by one of ordinary skill in the art to which this present disclosure belongs. The terminology used in the description herein is for describing particular embodiments only, and is not intended to be limiting of the present disclosure. As used in the description, the singular forms "a," "an," and "the" are intended to include the plural forms as well, unless the context clearly indicates otherwise. Unless otherwise indicated, all numbers expressing quantities, properties, and so forth as used in the specification are to be understood as being modified in all instances by the term "about." Accordingly, unless otherwise indicated, the numerical properties set forth in the following specification are approximations that may vary depending on the desired properties sought to be obtained in embodiments of the present disclosure. Notwithstanding that the numerical ranges and parameters setting forth the broad scope of the present disclosure are approximations, the numerical values to the extent that such are set forth in the specific examples are reported as precisely as possible. Any numerical values, however, inherently contain certain errors necessarily resulting from error found in their respective measurements.

As described herein, when one or more components are described as being connected, joined, affixed, coupled, attached, or otherwise interconnected, such interconnection may be direct as between the components or may be indirect such as through the use of one or more intermediary components. Also described herein, reference to a "member," "component," "element," or "portion" shall not be limited to a single structural member, component, element, or portion but can include an assembly of components, members, elements, or portions.

For many commercial and residential buildings, a shingled roof system can be supported by a support structure, which might typically be a plurality of trusses, secured to the top of the walls of the structure. The roof deck is secured to support structure typically by laying a sheet of roof deck material across the support structure and attaching the deck material to the support structure. Once the roof deck is installed, shingles are systematically coupled or attached to an outer surface of the roof deck in an overlapping pattern using fasteners, such as nails or screws, for example. In a typical shingled roof system, the fasteners are positioned and secured such that the next successive row of shingles overlaps and covers the part of the fasteners exposed above an upper surface of the previous row of shingles to prevent exposure of the fasteners to the elements. Some roof shingles have a sealing strip that keeps the exposed portion, often referred to as the prime portion, of the successive row of shingles down over the fasteners securing the previous row of shingles. The sealing strip is also intended to keep the exposed portion of the shingle from blowing up and potentially breaking off, leaving the underlying fasteners exposed to the elements. This can cause leaks in the roof and further damage to the underlying structure protected by the roof system.

The use of sealing strips has drawbacks. The sealing strip can be located on the upper surface of a covered headlap side of a shingle or on the lower surface of an exposed prime portion of the shingle. After installation of the shingle roof, radiation from the sun warms the shingles and causes the sealing strips on each shingle to melt and seal the upper surface of each shingle to the lower surface of the shingles overlapping them. In cold climates, the ambient temperature of the air may prevent the sealing strip from reaching its melting temperature and creating a seal with the overlapping shingle. This problem can be overcome by directing a heat source to the sealing strip, but employing a heat source can be time-consuming and resource intensive. In addition, increasing wind performance standards and requirements may increase the size or surface area of the sealing strips, which can increase the cost of shingles having sealing strips, among other problems.

It is desirable to have a more cost effective and efficient system for securing shingles to a roof in a manner capable of meeting increasing wind performance requirements and suitable for cold climate applications, for which sealing strips can be ineffective and/or inefficient.

The present disclosure is directed to roofing systems having a roof deck, a plurality of shingles, and a plurality of fasteners. In one exemplary embodiment, the fasteners have a material that partially changes state and displaces into the roof deck material to secure the fasteners and shingles to the roof deck. In another exemplary embodiment, the fastener has a head that is painted to match or substantially match a color of one or more granules on the shingle. In another exemplary embodiment, the fastener has a shank and/or a bottom of a head that is coated with an expanding and/or sealing material, such as a super absorbant polymer. The roof deck has an outer surface, and the shingles have an upper surface, a covered headlap portion, and an exposed prime portion. The shingles can be positioned above the outer surface of the roof deck in an overlapping manner such that the exposed prime portions of the shingles at least partially cover the covered headlap portions of shingles already attached to the roof deck. The fasteners have a first portion that is configured to penetrate through one or more shingles and into the roof deck.

In one exemplary embodiment, the first portion of the fasteners can have a material that can melt at a threshold temperature. When a force is applied to the fastener, the first portion penetrates into the roof deck, and a temperature of the first portion increases above the threshold temperature, which causes at least part of the material of the first portion to transition into a more flowable state (i.e. melt, undergo partial liquification, etc.) and displace into voids in the material of the roof deck. The displacement of a part of the material of the first portion into the voids of the material of the roof deck integrates the material of the first portion with the material of the roof deck, thereby securing the fastener to the roof deck. A second portion of the fastener engages with the upper surface of the shingle to secure the shingle to the roof deck.

In some embodiments of the present disclosure, the fasteners can be positioned along the covered headlap portion of the shingles so that the second portions of the fasteners are covered by shingles installed later. In some embodiments, fasteners can be positioned along the exposed prime portion of the shingles to further secure the shingle to the roof deck (a technique sometimes referred to as "face nailing"). In some embodiments, fasteners positioned along the exposed prime portion of the shingles can have a fastener color that is the same or similar to a shingle color of the shingle and/or that is the same or similar to a color of one or more granules on the shingle so that the second portion of the fasteners blend in with the color of the roof to improve the aesthetics of the roof. In some embodiments, metal fasteners can be used to attach the covered headlap portion of each shingle to the roof deck, and fasteners having a melting material can be used to secure the exposed prime portion of the shingles to the roof deck according to aspects of the present disclosure.

The present disclosure includes a method for attaching shingles to a roof deck. The method includes the steps of positioning the shingle on the roof deck, positioning a first portion of a fastener above an upper surface of the shingle, applying a force to the fastener such that the fastener penetrates the roof deck, and engaging the upper surface of the shingle with a second portion of the fastener to attach the shingle to the roof deck. The first portion of the fastener can have a shape configured to penetrate through the shingle and into the roof deck. In one exemplary embodiment, once the first portion of the fastener penetrates the roof deck, a temperature of the first portion increases above a threshold temperature, which causes at least a portion of a material of the first portion to melt, and the melted material displaces into voids of a material of the roof deck, which secures the fastener to the roof deck.

The method of the present disclosure can include the additional steps of positioning a subsequent shingle on the roof deck, positioning one or more subsequent fasteners above an upper surface of a subsequent shingle, applying force to the subsequent fasteners, and engaging the upper surface of the subsequent shingle with a second portion of the subsequent fasteners to attach the subsequent shingle to the roof deck. The subsequent shingle can be positioned on the roof deck such that a subsequent shingle exposed prime portion overlaps and covers over the covered headlap portion of a previously attached shingle. The subsequent fasteners can be positioned in a subsequent shingle covered headlap portion or in the subsequent shingle exposed prime portion.

The present disclosure will now be described with respect to the figures. Referring to FIG. 1A, a roofing system 10 that can include a roof deck 11, a plurality of shingles 20, and a plurality of fasteners 40 is illustrated. The roof deck 11 can have an outer surface 14 and can be supported by and attached to a support structure 16. The support structure 16 can include, but is not limited to, one or more trusses, for example. Each of the shingles 20 has an upper surface 22 that faces away from the roof deck 11, a covered headlap portion 26, and an exposed prime portion 28. In the embodiment depicted in FIG. 1A, the exposed prime portion 28 of the shingles 20 is shown as having one or more middle cutouts 24, and the covered headlap portion 26 is shown as being at least partially covered by the exposed prime portion 28 of another later-attached shingle. The shingles 20 can be positioned in an overlapping pattern such that the exposed prime portions 28 of the shingles 20 at least partially cover the covered headlap portions 26 of one or more previously installed shingles.

The fasteners 40 can be positioned above the upper surface 22 of the shingle 20. The fasteners 40 have a first portion 42 that can be configured/shaped to penetrate through one or more shingles 20 and into the roof deck 11. The fasteners 40 have second portions 44 that can be shaped to engage with the upper surfaces 22 of the shingles 20 to secure the shingles 20 to the roof deck 11. In the embodiment shown in FIG. 1A, the fasteners 40 can be positioned along the covered headlap portions 26 of the shingles 20.

As shown in FIG. 1A, a force "F" can be applied to the fasteners 40, causing the fasteners 40 to penetrate through one or more shingles 20 and into the roof deck 11. Upon penetration of the first portion 42 of the fastener 40 into the roof deck 11, friction between the material of the roof deck 11 and the first portion 42 causes the temperature of the first portion 42 to increase. When the temperature of the first portion 42 increases above a threshold temperature, at least a part of the material of the first portion 42 transitions into a more flowable state (i.e. melts, undergoes liquification, decreases in viscosity, etc.) and displaces into voids in the material of the roof deck 11 (melting and displacement of the material into voids in the material of the roof deck are not shown in FIG. 1A). Force "F" also causes the second portion 44 of the fastener 40 to engage with the upper surface 22 of the shingle 20 to attach the shingle 20 to the roof deck 11. The second portion 44 of the fastener 40 can engage with the upper surface 22 of the shingle 20 at an interface 45.

Figure 1B:
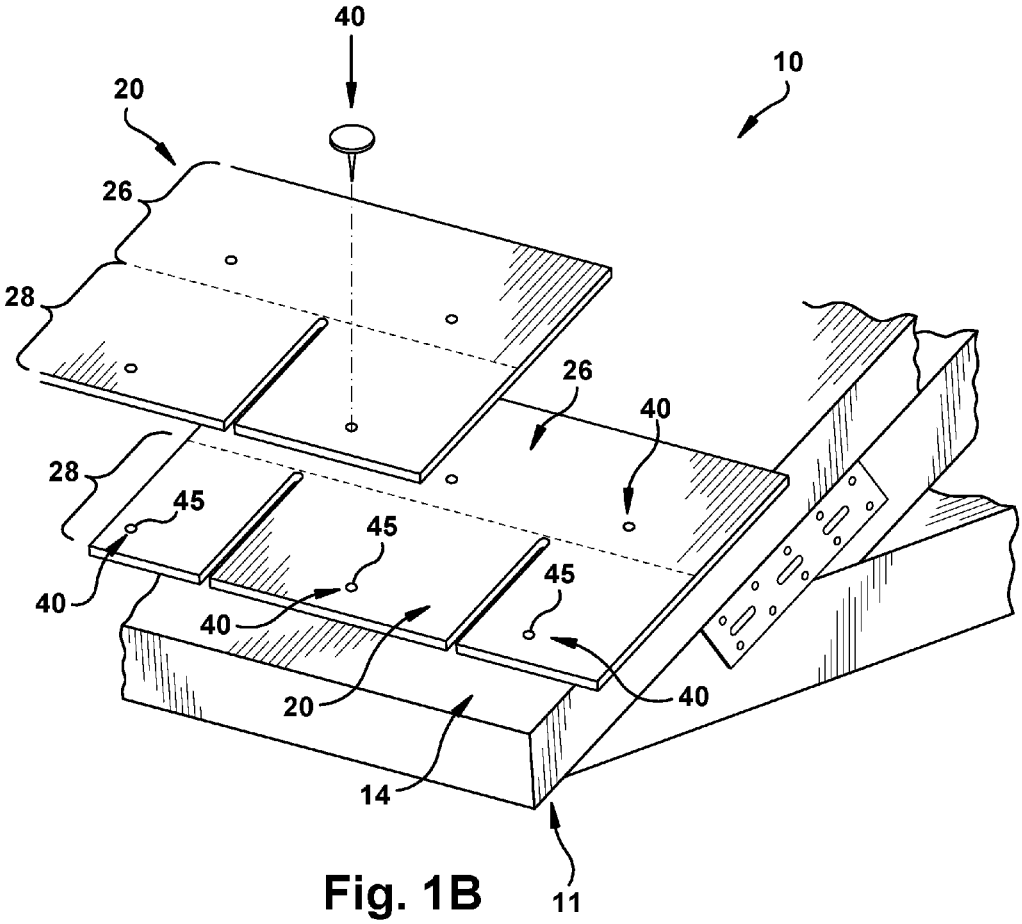
FIG. 1B is a perspective view of an exemplary embodiment of a roofing system in which the fasteners are also used to face nail the exposed prime portion of the shingles.

Referring now to FIG. 1B, an exemplary embodiment of a roof system 10 is illustrated. The roofing system 10 can include a roof deck 11, a plurality of shingles 20, and a plurality of fasteners 40. The shingles 20 can be positioned above the outer surface 14 of the roof deck 11 in an overlapping manner such that the upper surfaces 22 of the shingles 20 face generally away from the roof deck 11 and the covered headlap portions 26 of the shingles 20 are at least partially covered by the exposed prime portions 28 of other shingles 20. As shown in FIG. 1B, the fasteners 40 can be positioned along the covered headlap portions 26 of the shingles 20 and along the exposed prime portions 28 of the shingles 20. As illustrated, fasteners 40 positioned along the exposed prime portions 28 of the shingles 20 can secure the exposed prime portions 28 of the shingles 20 against wind and the elements. Positioning fasteners 40 along the exposed prime portions 28 of the shingles 20 can be referred to in the alternative as "face nailing" the shingles 20 to the roof deck 11. In some embodiments, fasteners 40 can be positioned mainly along the exposed prime portions 28 of the shingles 20 with few or no fasteners 40 attached along the covered headlap portions 26 of the shingles 20.

Figure 2A:
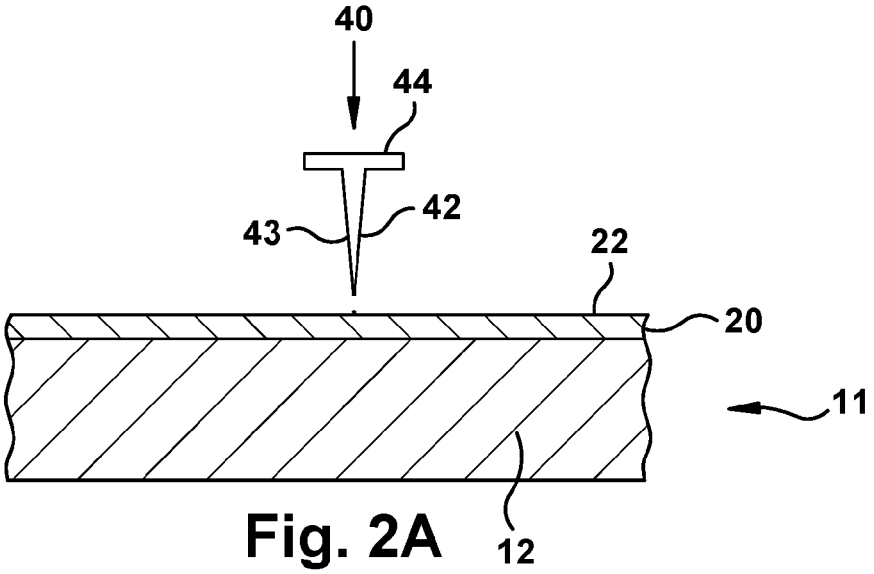
FIG. 2A is a cross-sectional view of a roofing system in which the fastener has been positioned above the upper surface of the shingle.
Figure 2B:
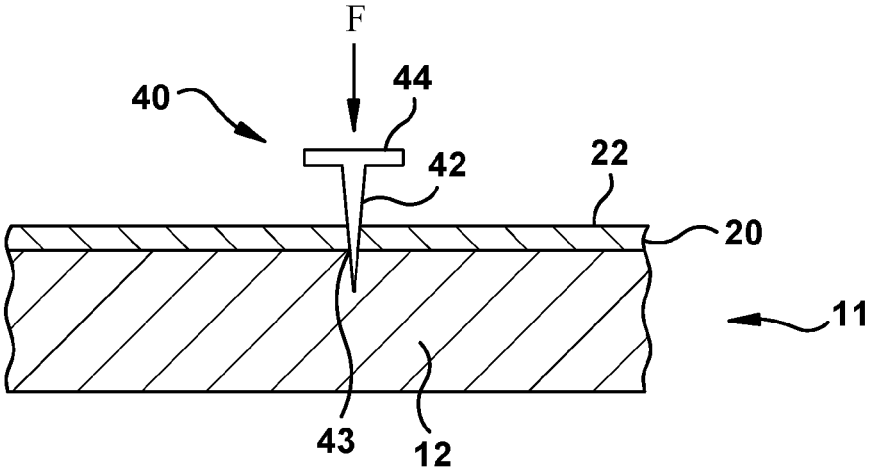
FIG. 2B is a cross-sectional view of a roofing system in which a force has been applied to cause the fastener to penetrate through the shingle and into the roof deck.
Figure 2C:
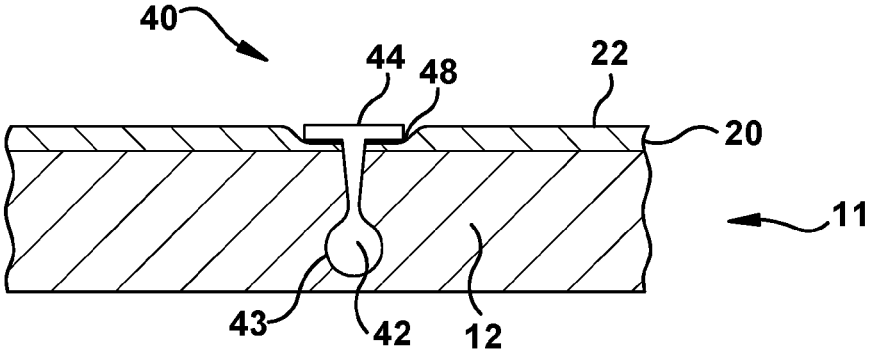
FIG. 2C is a cross-sectional view of a roof system in which material of the fastener has melted and displaced into voids in the roof deck material.

Referring now to FIGS. 2A-2C, an exemplary embodiment showing attachment of the fastener 40 and shingle(s) 20 to the roof deck 11 is illustrated. As shown in FIG. 2A, the fastener 40 can be positioned above the upper surface 22 of the shingle 20, which has been positioned above the roof deck 11. In some embodiments, the fastener 40 is positioned above the shingle 20 using a powered fastening apparatus, such as a power nailer, for example. In some embodiments, the fastener 40 can be positioned above the shingle 20 manually by hand. The fastener 40 can have a first portion 42 that is configured to penetrate through the shingle 20 and into the roof deck 11. The first portion 42 can include at least one material 43 having a threshold temperature, above which at least a part of the material 43 transitions into a more flowable state; the transition process including, but not limited to, melting, liquification, or viscosity decrease, for example.

In FIG. 2B, a force "F" can be applied to the fastener 40 in a manner causing the first portion 42 of the fastener 40 to penetrate through the shingle 20 and into the roof deck 11. The force "F" can be applied through operation of a powered fastening apparatus or through manual use of a hand tool, such as a hammer or palm nailer, for example. Powered fastening apparatus's can rely on electrical power, pneumatics, hydraulics, or other suitable power source to apply the force "F" to the fastener 40 and can include, but are not limited to, power nailers or nail guns, for example. In some embodiments, force "F" can be applied through the use of a pneumatic nail gun. Once the first portion 42 of the fastener 40 penetrates into the roof deck 11, the force "F" can continue to drive the first portion 42 further into the roof deck 11. As the first portion 42 penetrates further into the roof deck 11, movement of the first portion 42 through the roof deck material 12 creates frictional forces between the material 43 of the first portion 42 and the roof deck material 12. The frictional forces can generate heat, which can increase the temperature of the material 43 of the first portion 42 of the fastener 40.

As shown in FIG. 2C, once the temperature of the material 43 of the fastener 40 increases above a threshold temperature, the material 43 undergoes at least a partial change of state from a solid state to a more flowable condition or state and displaces into voids or void spaces in the roof deck material 12. A more flowable state can be characterized by the material 43 having a viscosity less than the viscosity of the solid material 43, at ambient conditions, such that the material 43 can displace into voids or void spaces in the roof deck material. Flowable states can include a liquid state or a semisolid state. Once the material 43 reaches the threshold temperature and changes to a more flowable state, the material 43 can displace into void spaces in the roof deck material 12. In some embodiments, only part of the material 43 changes to a flowable state and displaces into the void spaces in the roof deck material 12. This displacement of the material 43 of the first portion 42 into the surrounding roof deck material 12 can integrate the first portion 42 of the fastener 40 with the roof deck 11 and prevent the fastener 40 from backing out of the roof deck material 12. In some embodiments, displacement of the material 43 of the first portion 42 into the roof deck material 12 can create a generally fluid tight seal between the first portion 42 and the roof deck 11. The generally fluid tight seal can prevent water and other liquids from penetrating into the roof deck material 12 or through the roof deck 11.

Also shown in FIG. 2C, the second portion 44 of the fastener 40 engages with the upper surface 22 of the shingle 20, thereby securing the shingle 20 to the roof deck. In some embodiments similar to the embodiment shown in FIG. 2, the second portion 44 of the fastener 40 can deform or cause displacement of the upper surface 22 of the shingle 20. In some embodiments, displacement of the upper surface 22 of the shingle 20 by the second portion 44 of the fastener 40 can create a generally fluid tight seal 48 between the second portion 44 and the upper surface 22 of the shingle 20.

Figure 3:
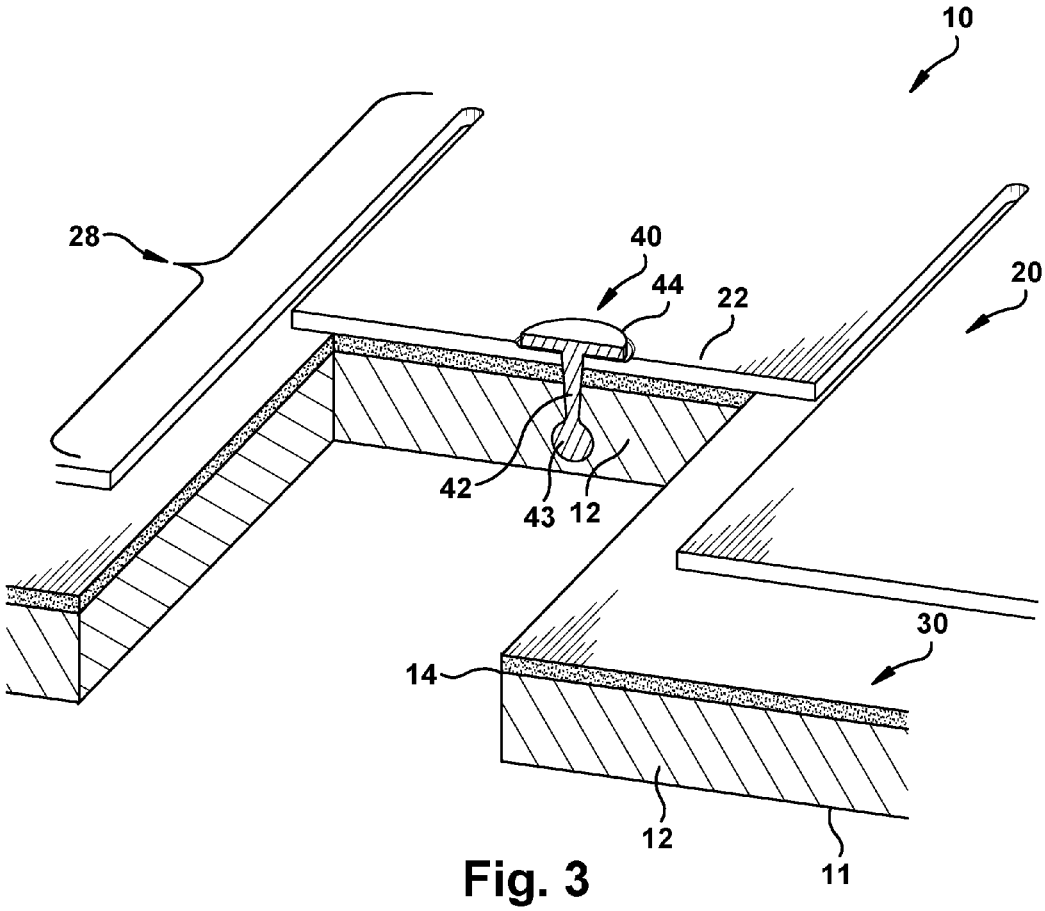
FIG. 3 is a cross-sectional perspective view of an exemplary embodiment of a roofing system showing the fastener securing the shingle to the roof deck.

Referring now to FIG. 3, another exemplary embodiment of a roof system 10 in which the exposed prime portion 28 of the shingle 20 is "face nailed" to the roof deck 11 is illustrated. As shown in FIG. 3, a shingle 20 can be positioned above the roof deck 11 such that the exposed prime portion 28 of the shingle 20 at least partially covers an existing shingle 30. In FIG. 3, existing shingle 30 refers to a shingle that is a part of the roof system 10 described in the figure and that has been positioned lower on the roof and, therefore, sequentially attached prior to positioning shingle 20. In some embodiments, the roof system 10 can be installed on top of an existing shingle roof such that an additional layer of shingle(s) is disposed between the shingle 20 and the roof deck 11. In some embodiments, other materials may be disposed between the shingle 20 and the roof deck 11. These other materials can include, but are not limited to, tar paper, other water resistant barrier material, reflective material, or other material, for example.

As shown in FIG. 3, the fastener 40 can be positioned along the exposed prime portion 28 of the shingle 20. In FIG. 3, the fastener 40 has already been installed to attach the shingle 20 to the roof deck 11. As illustrated, the first portion 42 of the fastener 40 can penetrate through shingle 20, through shingle 30, and into the roof deck 11, where the material 43 of the first portion 42 at least partially melts and displaces into voids in the roof deck material 12. The displacement of at least a portion of the material 43 of the first portion 42 of the fastener 40 into voids in the roof deck material 12 can secure the fastener 40 to the roof deck 11. The second portion 44 of the fastener 40 engages with the upper surface 22 of the shingle 20 to attach the shingle 20 to the roof deck 11. In some embodiments, the second portion 44 of the fastener 40 can cause deformation of the upper surface 22 of the shingle 20, which can create a generally fluid tight seal between the second portion 44 of the fastener 40 and the upper surface 22 of the shingle 20. In one exemplary embodiment, a seal material may be provided on a bottom of the second portion 44 of the fastener to create or enhance the seal between the second portion 44 of the fastener and the upper surface 22 of the shingle 20. In one exemplary embodiment, a seal material may be provided along the outside of the first portion 42 of the fastener 40 to create or enhance a seal between the first portion 42 of the fastener 40 and a hole in the shingle 20 that is caused by penetration of the fastener. The optional seal material can take a wide variety of different forms and can be applied to the first 42 and/or second 44 portions of the fastener 40. Examples of acceptable seal materials include, but are not limited to, rubber and rubber like materials such as elastomers, asphalt, and super absorbant polymers (SAP). Any material that provides a seal between the fastener 40 and the upper surface 22 of the shingle and/or between the fastener 40 and a hole formed in the shingle by the fastener can be used.

The roof deck material 12 can be a porous or semi-porous material having a plurality of void spaces disposed throughout the material. In some embodiments, the roof deck material 12 can be a fibrous material, which can include, but is not limited to, plywood, OSB (oriented strand board), or other wood-based material, for example. With roof deck material 12 that is a fibrous material, the voids or void spaces can be the spaces between fibers of different length and shape. In some embodiments, roof deck material 12 can be a non-fibrous material, such as a foam board, for example. In some embodiments, the roof deck 12 can be extruded polystyrene foam board. In a roof deck material 12 that is a foam-type non-fibrous material, the voids or void spaces can be small pockets of gas entrapped within the foam-type material. In some embodiments, the void spaces can be spaces created by penetration of the first portion 42 of the fastener 40 into the roof deck material 12 and can include cracks, crevices, creases, tears, or other openings mechanically created displacement of the roof deck material 12 by the penetrating first portion 42 of the fastener 40. The roof deck 11 can be alternatively or additionally referred to as the "sheathing" or "sheeting," and the roof deck material 12 can be correspondingly referred to as "sheathing material" or "sheeting material." The roof deck 11 has an outer surface 14 that is the surface generally facing away from the structure protected by the roof system 10.

Figure 4A:
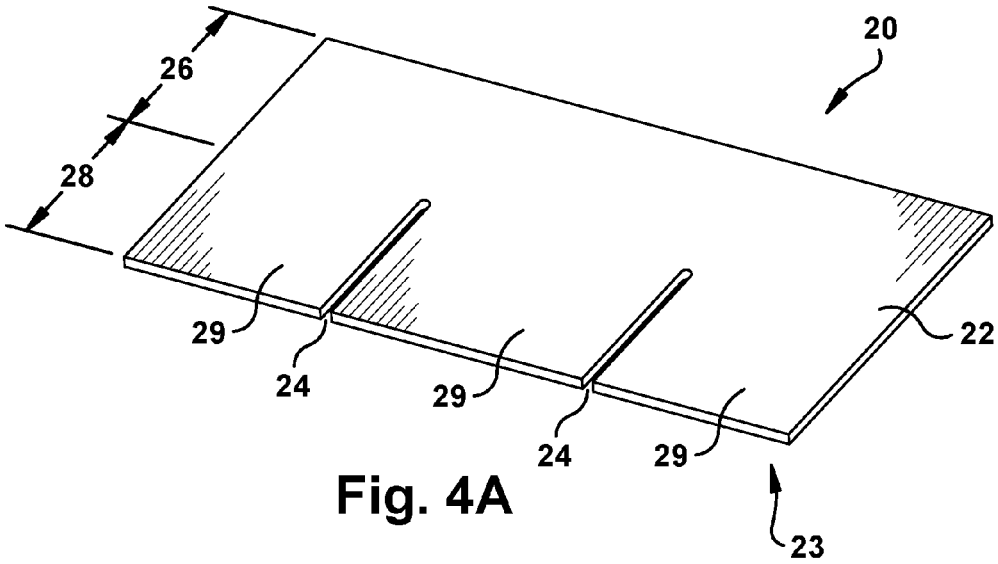
FIGS. 4A-4B are perspective views of exemplary embodiments of shingles employed in a roofing system of the present disclosure.
Figure 4B:
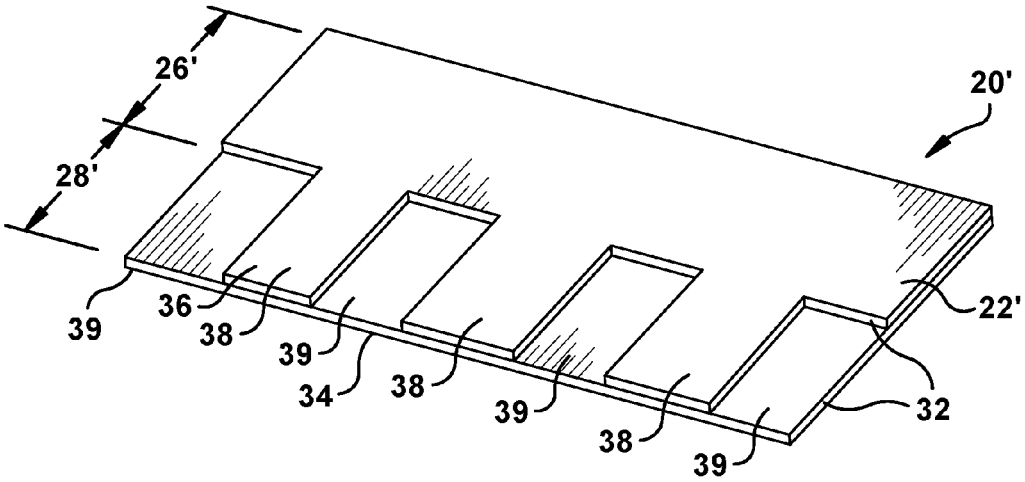

Referring now to FIGS. 4A-4B, example embodiments of shingle 20 are illustrated. Shingles 20 can be made of many different materials, including metal, fiberglass, asphalt, wood, rubber, fibre cement, plastic, ceramic coated granules, combinations thereof, other materials, or composite materials, for example. In some embodiments, the shingles 20 can be fiberglass shingles. In some embodiments, the shingles 20 can be asphalt shingles. Shingles 20 can come in a variety of shapes and colors and can include one or more layers of material. Generally, shingles 20 can have an upper surface 22 facing away from the roof deck and a lower surface 24 facing towards the roof deck. In some embodiments, the upper surface 22 of the shingles 20 can be coated with one or more surface coating materials (not shown) that can provide coloring, reflective properties, texture, or other properties to the shingles 20. In some embodiments, the shingles include colored granules on exposed surface. These colored granules may have one or more different colors. Shingles 20 can have covered headlap portions 26, which are generally the portions of the shingles 20 covered up by subsequent shingles when the shingles 20 are arranged and attached to the roof deck in an overlapping pattern. The shingles 20 can have exposed prime portions 28, which are generally the portions of the shingles 20 exposed to the elements. The exposed prime portions 28 of the shingles 20 can be referred to alternatively or additionally as tab portions or butt portions. In some embodiments, the aforementioned surface coating materials can be applied only to the upper surface 22 of the exposed prime portions 28 of the shingles 20.

FIG. 4A depicts an exemplary embodiment of a shingle 20 that is a tab shingle. As shown in FIG. 4A, the shingle 20 can be a single layer and can have one or more cutouts 24 in the exposed prime portion 28 such that the cutouts 24 divide the exposed prime portion 28 into a plurality of tabs 29. The cutouts 24 can be referred to alternatively or additionally as middle cutouts or slots. The exemplary embodiment in FIG. 4A has 2 cutouts 24 that divide the exposed prime portion 28 of the shingle 20 into 3 tabs 29. A person having ordinary skill in the art can appreciate that the number of cutouts 24 can vary, thus, varying the number of tabs 29.

FIG. 4B depicts an exemplary embodiment of a laminated shingle 20'. In FIG. 4B the prime symbol is used to identify features and characteristics that are similar to corresponding features and characteristics of the embodiment in FIG. 4A. A laminated shingle 20' can be referred to alternatively or additionally as an architectural shingle or dimensional shingle. As shown in FIG. 4B, a laminated shingle 20' can have an upper surface 22', a covered headlap portion 26', and an exposed prime portion 28'. The laminated shingle 20' can include a plurality of laminations 32, which can be referred to alternatively and/or additionally as layers. In the embodiment shown in FIG. 4B, the laminated shingle 20' can have 2 laminations 32 that include a first lamination 34 and a second lamination 36. The first lamination 34 can be a continuous lamination, and the second lamination 36 can be a continuous lamination or can have a shape that at least partially exposes the first lamination 34 underneath. In the embodiment depicted in FIG. 4B, the second lamination 36 can have a shape having one or more tab portions 38 alternating with one or more cutout openings 39 such that the underlying first lamination 34 is exposed in the cutout openings 39. The second lamination 36 can have a variety of shapes designed to create various visual effects and/or achieve other performance objectives. In some embodiments, the laminations 32 can be coupled together such that the laminations cannot be easily separated. In some embodiments, laminated shingles 20' can have more than 2 laminations 32.

In some embodiments, shingles 20, 20' can have sealing strips (not shown) that can create a seal between the upper surface 22, 22' of the covered headlap portion 26, 26' of one shingle 20, 20' and the lower surface 23 of the exposed prime portion 28, 28' of a subsequent shingle. In some embodiments, the sealing strip can be a material that has a melting temperature. In some embodiments, the shingle 20, 20' can have a sealing strip disposed on the upper surface 22, 22' of the covered headlap portion 26, 26' of the shingle 20, 20'. In some embodiments, the shingle 20, 20' can have a sealing strip disposed on the lower surface 22, 22' of the exposed prime portion 28, 28'.

Figure 5A:
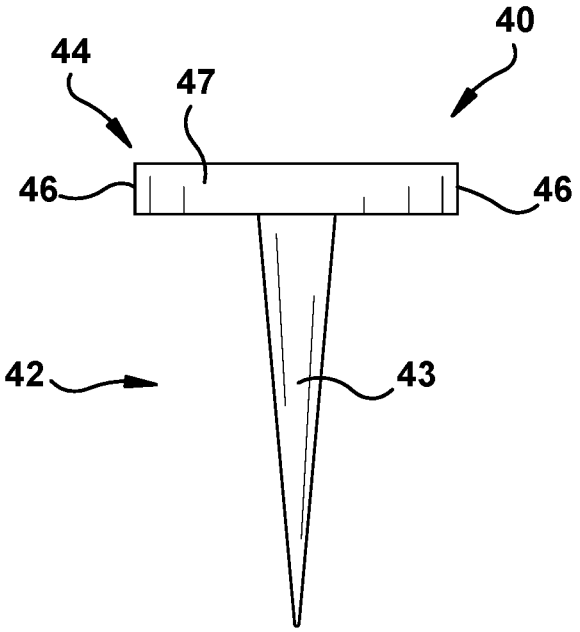
FIG. 5A is a side view of an exemplary embodiment of a fastener employed in a roofing system of the present disclosure.
Figure 5B:
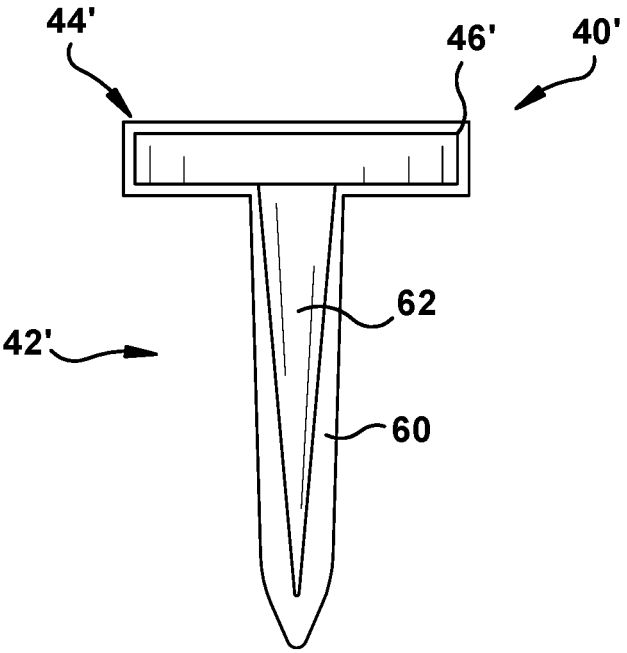
FIG. 5B is a side view of an exemplary embodiment of a composite fastener employed in a roofing system of the present disclosure.

Referring now to FIGS. 5A-5B, exemplary embodiments of fasteners 40 are illustrated. The prime symbol is used in FIG. 5B to denote features and/or characteristics of the embodiment in FIG. 5B that are similar to features and/or characteristics of the embodiment in FIG. 5A. The fasteners 40 can take a wide variety of different forms. As shown in FIG. 5A, a fastener 40 can have a first portion 42 and a second portion 44. The first portion 42 can be configured to penetrate through one or more shingles and into the roof deck. In some embodiments, the first portion 42 can be configured to generate friction upon penetrating into the roof deck material.

The first portion 42 can include a material 43 that is in a solid phase at ambient temperature and has a threshold temperature above which the material 43 transitions to an excited state. The excited state can include a change in phase from the solid phase to an at least partially flowable phase. The flowable phase can be a liquid phase or semi-solid phase having a viscosity less than the viscosity of the material 43 in the solid phase such that the material 43 can at least partially displace into void spaces in the roof deck material. The material 43 can be a plastic or thermoplastic material. In some embodiments, the material 43 can have a threshold temperature such that frictional forces caused by penetration of the first portion 42 through the roof deck material are sufficient to raise the temperature of the material 43 above the threshold temperature. In some embodiments, the material 43 can have a threshold temperature high enough to require a secondary source of excitation to accomplish the transition to the excited state. Secondary sources of excitation may employ heat, ultrasonic vibration, radiation, or other physical phenomena to cause the transition to a more flowable state.

In the examples illustrated by FIGS. 5A and 5B, the fastener 40 is a nail. As shown in FIG. 5A, the second portion 44 of the fastener 40 can be configured to engage with the upper surface of a shingle to attach the shingle to the roof deck. In the embodiment depicted in FIG. 5A, the second portion 44 can be a generally flat plate from which the first portion 42 extends in a generally perpendicular direction. The second portion 44 can have a periphery 46 that can have any suitable shape. In some embodiments, the periphery 46 of the second portion 44 can be shaped such that the fastener 40 can integrate with and be applied by a powered fastening apparatus, such as a pneumatic or electric nail gun, for example. In some embodiments, the periphery 46 can be generally circular such that the fastener 40 can be positioned and fastened by hand using a hand tool. In some embodiments, the second portion 44 can have a fastener color 47 that can be similar to a color of the shingle and/or a color of a granule on the shingle. The shingle color can be referred to alternatively and/or additionally as a first color, and the fastener color 47 can be referred to alternatively and/or additionally as a second color. In one exemplary embodiment, the first color matches or substantially matches the second color. In some embodiments, the entire fastener 40 can have a fastener color 47.

Referring now to FIG. 5B, an embodiment of a composite fastener 40' is illustrated. The composite fastener 40' can include a first material 60 and one or more second materials 62. The second materials 62 can be any suitable material, including, but not limited to, wood, metal, plastic, fiberglass, other material, or combinations thereof. In one exemplary embodiment, the first material 60 can be a plastic or thermoplastic material similar in characteristics to the material 43 of the first portion 42 described in association with FIG. 5A. The first material 60 can have a threshold temperature, above which the first material 60 transitions to an excited state. The excited state can be a more flowable state characterized by a change in phase of at least a portion of the first material 60 from the solid phase to a liquid or semi-solid phase having a viscosity sufficient to allow the first material 60 to displace into voids within a roof deck material. In some embodiments, the composite fastener 40' can have a first material 60 that is a coating covering the second material(s) 62. In some embodiments, the composite fastener 40' can include a second material 62 that is a metal and a first material 60 that is a plastic such that the composite fastener 40' is a nail encased and/or covered in plastic.

In one exemplary embodiment, the first material 60 is a seal material. The seal material creates or enhances a seal between the fastener 40 and the upper surface 22 of the shingle and/or a seal between the fastener 40 and a hole in the shingle 20 that is caused by penetration of the fastener. The first material can take a wide variety of different forms. The first material 60 may be rubber or rubber-like materials, such as elastomers, asphalt, super absorbent polymers, plastics, and the like.

Figure 5C:
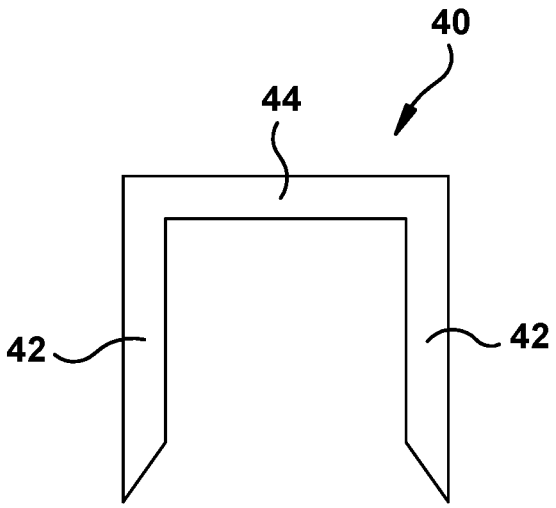
FIG. 5C is a side view of an exemplary embodiment of a fastener employed in a roofing system of the present disclosure.
Figure 5D:
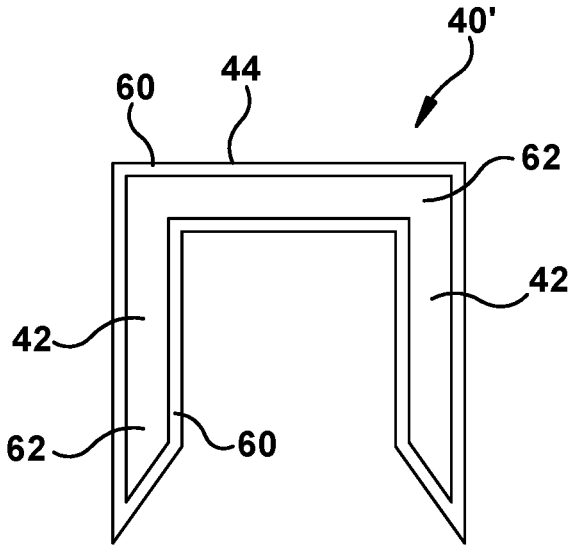
FIG. 5D is a side view of an exemplary embodiment of a composite fastener employed in a roofing system of the present disclosure.

In the examples illustrated by FIGS. 5C and 5D, the fastener 40 is a staple. As shown in FIG. 5C, the second portion 44 of the fastener 40 can be configured to engage with the upper surface of a shingle to attach the shingle to the roof deck. In the embodiment depicted in FIG. 5A, the second portion 44 can be a strip from which two first portions 42 extend in a generally perpendicular direction. The second portion 44 can have any suitable shape. In some embodiments, staple can be shaped to be applied by a powered fastening apparatus, such as a pneumatic or electric staple gun, for example. In some embodiments, the second portion 44 can have a fastener color that can be the same or similar to a color of the shingle. In some embodiments, the entire fastener 40 can have a fastener color.

Referring now to FIG. 5D, an embodiment of a composite fastener 40' is illustrated. The composite fastener 40' can include a first material 60 and one or more second materials 62. The second materials 62 can be any suitable material, including, but not limited to, wood, metal, plastic, fiberglass, other material, or combinations thereof. The first material 60 can be a plastic or thermoplastic material similar in characteristics to the material 43 of the first portion 42 described in association with FIGS. 5A and 5B. The first material 60 can have a threshold temperature, above which the first material 60 transitions to an excited state and/or the first material may comprise a seal material. The excited state can be a more flowable state characterized by a change in phase of at least a portion of the first material 60 from the solid phase to a liquid or semi-solid phase having a viscosity sufficient to allow the first material 60 to displace into voids within a roof deck material. In some embodiments, the composite fastener 40' can have a first material 60 that is a coating covering the second material(s) 62. In some embodiments, the composite fastener 40' can include a second material 62 that is a metal and a first material 60 that is a plastic such that the composite fastener 40' is a staple encased and/or covered in plastic.

Figure 6:
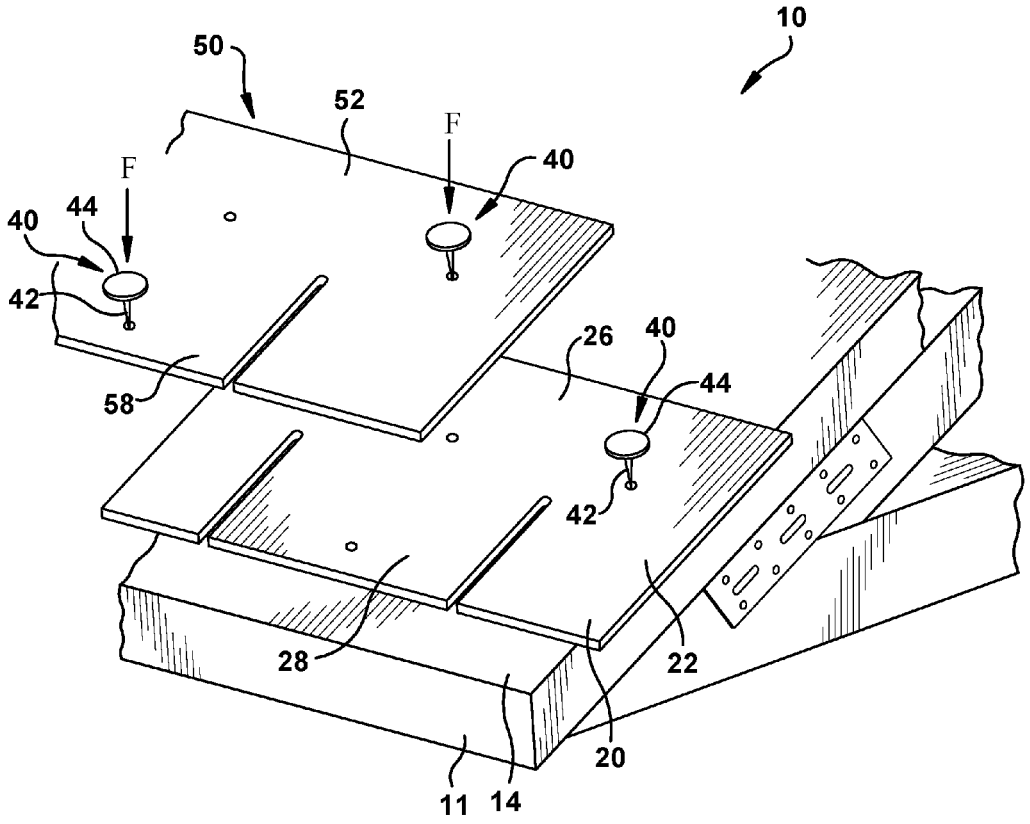
FIG. 6 is a perspective view of an exemplary embodiment of a roof system.

Referring now to the roof system 10 illustrated in FIG. 6, a method for attaching a shingle 20 to a roof deck 11 will now be described. In the example illustrated by FIG. 6, some or all of the fasteners 40 are applied through the exposed or prime portions 28 of the shingles 20. In one exemplary embodiment, a color of the fastener or an exposed or visible portion of the fastener has the same color as the prime portion 28 of the shingle 20 or some or all of the granules on the exposed or prime portion 28.

The method for attaching a shingle 20 to a roof deck 11 can include the following steps: positioning the shingle 20 above the roof deck 11; positioning a first portion 42 of a fastener 40 above an upper surface 22 of the shingle 20; applying a force "F" to the fastener 40 such that the fastener 40 penetrates through the shingle 20 and into the roof deck 11. In one exemplary embodiment, a temperature of the fastener 40 rises above a threshold temperature, causing at least a portion of a material of the fastener 40 to melt and displace into voids in a material of the roof deck 11; and engaging the upper surface 22 of the shingle 20 with a second portion 44 of the fastener 40 to attach the shingle 20 to the roof deck 11. The fastener 40 may provide a seal with the shingle 20. In the positioning the shingle step, the shingle 20 can be positioned above the outer surface 14 of the roof deck 11 such that the upper surface 22 of the shingle 20 faces away from the roof deck 11. In the positioning the fastener 40 step, the first portion 42 of the fastener 40 can be configured to penetrate through the shingle 20 and into the roof deck 11.

The method for attaching a shingle 20 to a roof deck 11 can also include the step of allowing the material of the first portion 42 to solidify, thereby integrating the material of the first portion 42 with the material of the roof deck 11. In some embodiments, the method of attaching a shingle 20 to a roof deck 11 can further include the following steps: positioning a subsequent shingle 50 on the roof deck 11 such that a subsequent shingle exposed prime portion 58 at least partially covers a covered headlap portion 26 of the shingle 20; positioning a first portion 42 of a fastener 40 above a subsequent shingle upper surface 52; applying a force "F" to the fastener 40 such that the fastener 40 penetrates through the subsequent shingle 50 and into the roof deck 11 and such that a temperature of the fastener 40 rises above a threshold temperature, causing at least a portion of a material of the fastener 40 to melt and displace into voids in a material of the roof deck 11; and engaging the subsequent shingle upper surface 52 of with a second portion 44 of the fastener 40 to attach the subsequent shingle 50 to the roof deck 11. In the positioning a fastener 40 step, the fastener 40 can also be a subsequent fastener. In the applying a force to the fastener 40 step, the fastener 40 can be positioned above the subsequent shingle exposed prime portion 58 such that the force "F" can cause the first portion 42 of the fastener 40 to penetrate through the subsequent shingle 50, through the shingle 20 underneath the subsequent shingle 50, and into the roof deck 11, where the material then melts and displaces into the voids in the material of the roof deck 11. In some embodiments, the aforementioned method steps directed to attachment of shingles 20 and subsequent shingles 50 can be repeated until the entire roof structure is protected by the roof system 10.

While various aspects, concepts, and features of the present disclosure may be described and illustrated herein as embodied in combination in the exemplary embodiments, these various aspects, concepts, and features may be used in many alternative embodiments, either individually or in various combinations and sub-combinations thereof. Unless expressly excluded herein, all such combinations and sub-combinations are intended to be within the scope of the present disclosure. While various embodiments as to the various aspects, concepts, and features of the present disclosure—such as alternative materials, structures, configurations, methods, circuits, devices, components, hardware, alternatives as to form, fit and function, and so on—may be described herein, such descriptions are not intended to be a complete or exhaustive list of available alternative embodiments, whether presently known or later developed. Those skilled in the art may readily adopt one or more of the aspects, concepts, or features into additional embodiments and uses within the scope of the present disclosure, even if such embodiments are not expressly disclosed herein. Additionally, even though some aspects, concepts, and/or features of the present disclosure may be described herein as being a preferred arrangement or method, such description is not intended to suggest that such feature is required or necessary unless expressly so stated. Exemplary or representative values and ranges may be included to assist in understanding the present disclosure, however, such values and ranges are not to be construed in a limiting sense and are intended to be critical values or ranges only if so expressly stated. Descriptions of exemplary methods or processes are not limited to inclusion of all steps as being required in all cases, nor is the order that the steps are presented to be construed as required or necessary unless expressly so stated.

While the present disclosure has been illustrated by the description of embodiments thereof, and while the embodiments have been described in considerable detail, it is not the intention of the applicant to restrict or in any way limit the scope of the invention to such detail. Additional advantages and modifications will readily appear to those skilled in the art. For example, the specific locations of the component connections and interplacements can be modified. Therefore, the present disclosure, in its broadest aspects, is not limited to the specific details, the representative apparatus, and illustrative examples shown and described. Accordingly, departures can be made from such details without departing from the spirit or scope of the applicant's general inventive concept.

What is claimed is:

1. A roofing system comprising:

a roof deck having an outer surface;

a plurality of shingles having exposed prime portions and covered headlap portions, wherein the plurality of shingles are positioned above the roof deck in an overlapping pattern such that the exposed prime portions of the plurality of shingles at least partially cover the covered headlap portions of one or more previously attached shingles;

a plurality of fasteners having first portions configured to penetrate into the roof deck;

wherein the plurality of fasteners extend through one or more of the plurality of shingles and into the roof deck;

wherein melted material of the first portions of the plurality of fasteners is displaced into voids in a material of the roof deck to secure the plurality of fasteners to the roof deck; and wherein second portions of the plurality of fasteners are engaged with one or more of the plurality of shingles to attach the plurality of shingles to the roof deck.

2. The system of claim 1 further comprising a plurality of metal fasteners, wherein each of the plurality of metal fasteners is positioned in the covered headlap portions at least one of the plurality of shingles such that each of the plurality of metal fasteners attaches the covered headlap portion of the at least one of the plurality of shingles to the roof deck and are covered by the covered headlap portions of at least another one of the plurality of shingles, and wherein each of the plurality of fasteners is positioned in the exposed prime portion of at least one of the plurality of shingles such that the plurality of fasteners attach the exposed prime portions of the plurality of shingles to the roof deck.

3. The system of claim 1 wherein the roof deck is a fibrous material.

4. The system of claim 3 wherein the roof deck is wood.

5. The system of claim 1 wherein the roof deck is foam.

6. The system of claim 5 wherein the roof deck is extruded polystyrene foam board.

7. The system of claim 1 wherein each of the plurality of shingles comprises a covered headlap portion and an exposed prime portion.

8. The system of claim 7 wherein each of the plurality of fasteners is positioned in the covered headlap portion of at least one of the plurality of shingles such that each of the plurality of fasteners is covered by at the exposed prime portion of the at least one of the plurality of shingles.

9. The system of claim 1 wherein one or more of the plurality of fasteners is positioned in the exposed prime portions of one or more of the plurality of shingles.

10. The system of claim 9 wherein the upper surfaces of the plurality of shingles have a shingle color and wherein the plurality of fasteners have a fastener color that is substantially similar to the shingle color.

11. The system of claim 10 wherein the upper surfaces of the plurality of shingles have a shingle color and wherein the second portions of the plurality of fasteners have a fastener color that is substantially similar to the shingle color.

12. A method of coupling a shingle to a roof deck, the method comprising:

positioning the shingle above the roof deck;

positioning a first portion of a fastener above an upper surface of the shingle, wherein the fastener is shaped to penetrate through the shingle and into the roof deck;

applying a force to the fastener such that the first portion of the fastener penetrates the roof deck;

wherein upon penetration of the first portion into the roof deck, a temperature of the first portion of the fastener rises above a threshold temperature, which melts at least a portion of a material of the first portion;

wherein melted material of the first portion displaces into voids in a roof deck material; and engaging the upper surface of the shingle with a second portion of the fastener to attach the shingle to the roof deck.

13. The method of claim 12 further comprising allowing the melted material of the first portion to solidify, thereby integrating the melted material of the first portion into the material of the roof deck, which secures the fastener to the roof deck.

14. The method of claim 12 wherein the roof deck is a fibrous material.

15. The method of claim 14 wherein the roof deck is wood.

16. The method of claim 12 wherein the roof deck is foam.

17. The method of claim 16 wherein the roof deck is extruded polystyrene foam board.

18. The method of claim 12 wherein the shingle comprises a covered headlap portion and an exposed prime portion.

19. The method of claim 18 wherein the fastener is positioned in the covered headlap portion such that the fastener becomes covered by one or more subsequent shingles.

20. The method of claim 18 wherein the fastener is positioned in the exposed prime portion of the shingle.

21. The method of claim 20 wherein the material of the second portion of the fastener creates a seal with the shingle.

22. The method of claim 20 wherein the fastener has a first color.

23. The method of claim 22 wherein the shingle has a second color and wherein the first color is substantially similar to the second color.

24. The method of claim 20 further comprising the steps of:

positioning a subsequent shingle, having a subsequent shingle covered headlap portion and a subsequent shingle exposed prime portion, on the roof deck such that the subsequent shingle exposed prime portion at least partially covers the covered headlap portion of the shingle;

positioning a first portion of a subsequent fastener above a subsequent shingle upper surface, wherein the first portion of the subsequent fastener is shaped to penetrate through the subsequent shingle, through the shingle, and into the roof deck;

applying a force to the subsequent fastener such that the first portion of the subsequent fastener penetrates into the roof deck;

wherein upon penetration of the first portion of the subsequent fastener into the roof deck, a temperature of the first portion of the subsequent fastener rises above the threshold temperature, which melts at least a portion of a material of the first portion of the subsequent fastener;

wherein the melted material of the first portion of the subsequent fastener displaces into voids of the material of the roof deck; and engaging the subsequent shingle upper surface with a second portion of the subsequent fastener to attach the subsequent shingle to the roof deck.

25. The method of claim 24 further comprising allowing the melted material of the first portion of the subsequent fastener to solidify, integrating the melted material of the first portion of the subsequent fastener into the material of the roof deck, thereby securing the subsequent fastener to the roof deck.

* * * * *